United States Patent [19]

Harte et al.

[11] Patent Number: 4,833,799

[45] Date of Patent: May 30, 1989

[54] AUTOMOTIVE SNOW PLOW WITH TOW RING RECEIVING PUSH BAR PLATES

[76] Inventors: Francis A. Harte, 620 Somerset Dr., Slingerlands, N.Y. 12159; Mark E. Fusco, 72 Sparrowbush Rd., Latham, N.Y. 12110

[21] Appl. No.: 229,626

[22] Filed: Aug. 8, 1988

[51] Int. Cl.[4] ..... E01H 5/04

[52] U.S. Cl. ..... 37/231; 37/279; 172/811; 172/273; 172/274

[58] Field of Search ..... 37/231, 266, 270, 271, 37/272, 279; 172/811, 272, 273, 274

[56] References Cited

U.S. PATENT DOCUMENTS

| | | | |
|---|---|---|---|
| 1,020,727 | 3/1912 | Sutcliffe . | |
| 1,698,809 | 1/1929 | Angell | 37/279 |
| 2,345,460 | 3/1944 | Coderre . | |
| 2,430,221 | 11/1947 | Frink et al. | 37/279 |
| 2,468,950 | 5/1949 | Wiedman | 37/231 |
| 2,962,821 | 12/1960 | Peitl | 37/279 |
| 3,098,309 | 7/1963 | Koch | 37/231 |
| 3,302,958 | 2/1967 | Fawcett et al. | 37/231 |
| 3,349,507 | 10/1967 | Payne | 37/231 |
| 3,760,516 | 9/1973 | Billingsley | 37/231 |
| 3,845,577 | 11/1974 | Naymik . | |
| 4,342,163 | 8/1982 | Hoekstra | 37/231 |
| 4,769,933 | 9/1988 | Dejana | 37/231 |

*Primary Examiner*—Eugene M. Eickholt

[57] ABSTRACT

A high strength light weight synthetic resin snow removal device is adapted for easy connection to small passenger vehicles having tow rings depending therefrom.

7 Claims, 3 Drawing Sheets

AUTOMOTIVE SNOW PLOW WITH TOW RING RECEIVING PUSH BAR PLATES

This invention relates to an improved automotive snow removal device, and more particularly to a light weight durable snow plow or blade assembly which is easily installed on and removable from the chassis of smaller automotive vehicles.

DESCRIPTION OF THE PRIOR ART

Snow plow or blade devices adapated for attachment to automotive vehicles are known in the art. U.S. Pat. No. 2,333,361—Churchill 11/2/43 discloses and describes a snow removal apparatus adapted to be attached to the front of an automotive vehicle.

U.S. Pat. No. 2,350,437—Wiedman 3/12/41 disloses and describes a snow plow which is attached to the front of a family automobile. A frame which supports the plow is adapted to be readily demountable to be capable of storage in the trunk of the automobile.

These and other snow removable devices adapted for attachment to automotive vehicles, particularly those vehicles referred to as family or passenger vehicles, are usually manufactured from traditional high strength materials, for example, steel angles, rods and braces. For this reason, the snow removal devices as described are cumbersome because of their great weight and it is, therefore, difficult to install such devices on automotive vehicles and to remove them therefrom. A more desirable removal device is one of lesser weight which can be easily installed on and removed from passenger type automotive vehicles.

OBJECTS OF THE INVENTION

Accordingly, it is an object of this invention to provide an improved and light weight snow removal device for automotive vehicles, particularly smaller passenger vehicles.

It is another object of this invention to provide an improved and light weight snow removal device for automotive vehicles in which lighter synthetic resin materials are employed to replace prior used heavier steel materials.

It is yet another object of this invention to provide a smaller but efficient light weight snow plow or blade assembly with simplified attachment means for attachment to small passenger vehicles.

It is a further object of this invention to provide a push type light weight snow plow or snow blade device for smaller passenger type automotive vehicles which is particularly adapted for easy attachment to the chassis of such vehicles without the necessity of any alteration or change in the structure of the vehicle as usually sold and delivered to the customer, and without deleteriously affecting the ordinary function of the vehicle or its components.

SUMMARY OF THE INVENTION

A strong light weight synthetic resin snow removal device is adapted for simplified attachment to tie down or towing rings found on small passenger vehicles imported into the U.S.A. from European and Asiatic countries. A generally narrow rectangular synthetic resin snow blade or scraper blade is curved about its longitudinal axis and attached to the ends of a pair of spaced apart parallel high strength synthetic resin push bars, the other ends of which attach to a ring on an automotive chassis. Each push bar is comprised of a pair of plates mounted on their one end to the blade for pressing engagement with each other, but separable at their said other ends to receive a tow ring. Also each push bar is provided with an aperture passing through its plates at its said other end and a pin for insertion through the aperture in order to capture the tow ring. Commercially available synthetic resins, with or without strengthening fillers, for this device include polycarbonate resin and its high strength modifications, nylon resins, acetal resins and polyolefin resins.

Other objects and advantages of this invention will be better understood when taken in connection with the following description and drawings.

DESCRIPTION OF A PREFERRED EMBODIMENT OF INVENTION

In this specification it is to be understood that references to automotive vehicle parts and movement are to be given their generally widely accepted definitions in the art at the present time. Such terms as forward, reverse, front, under the bumper, chassis, etc. need no specific additional definition.

Figure 1:
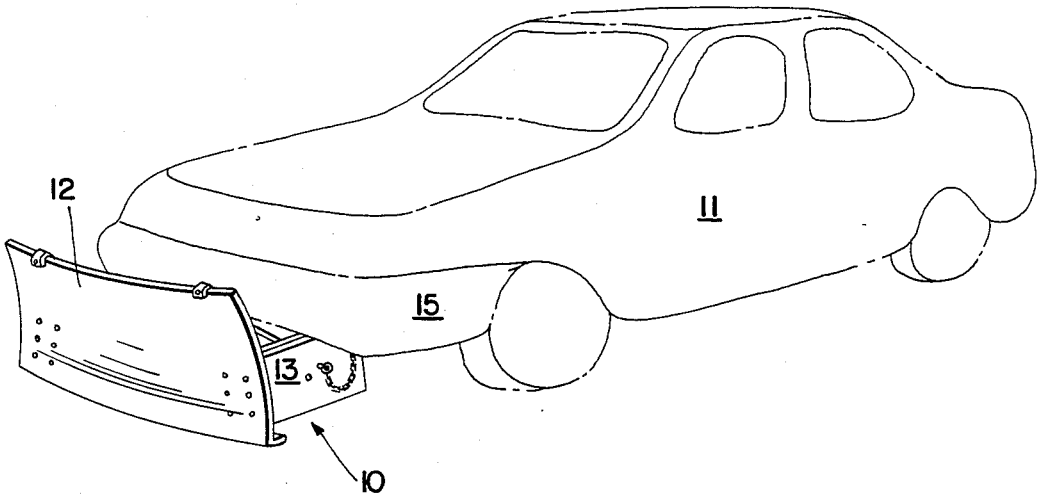
FIG. 1 is a schematic illustration of one form of the snow blade or plow of this invention installed on a small passenger vehicle.

The general character of this invention is best described with respect to FIG. 1.

Referring now to FIG. 1 there is illustrated a combination of a snow blade device 10 attached to the chassis of a passenger automotive vehicle 11. Snow blade device 10 comprises a snow or scraper blade 12 attached to a pair of push bars or brackets 13 (FIG. 2) and 14 which pass under the front bumper 15 and are securly attached to the chassis of automotive vehicle 11.

Figure 2:
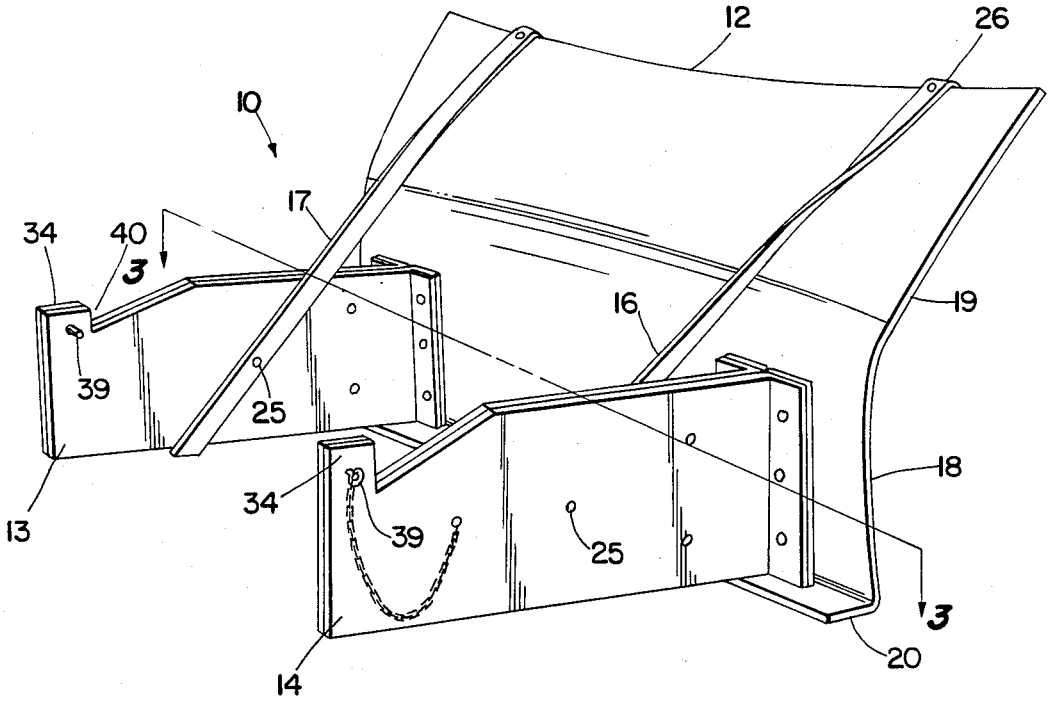
FIG. 2 is a schematic and orthagonal view of the snow blade of FIG. 1 from a right rear quarter viewing position.

Referring now to FIG. 2, snow blade device 10 comprises a snow blade 12, a pair of push bars or mounting brackets 13 and 14, and braces 16 and 17 for blade 12.

In accordance with light weight practices and teachings of this invention, most components of the snow blade device 10 are manufactured from light weight, but tough and durable synthetic resin materials. Very high forces and stresses are imposed on snow blade 12 by reason of forcing snow blade 12 transversely perpendicularly through a thick layer of snow usually at the entranceway of an automotive garage or domestic residence. Accordingly, the synthetic resin material for snow blade 12 must be a very tough and durable resin material, made thicker where necessary and suitably braced where bending forces are at a maximum. Certain more common synthetic resins are very workable and easily formable into complex shapes and may be strengthened by appropriate chemical modification or filler materials. A common resin may be one from the class of polyolefin resins which may include polystyrene, polyethylene and polypropylene.

Polyolefin resins are generally soft, with relatively low abrasion resistance and a tensile strength of about 5,000 lbs. psi. However, ultrahigh molecular weight polyethylene has the highest impact resistance of all thermal plastics. It maintains its impact resistance down to the cryogenic ranges, unlike polycarbonates. Ultrahigh molecular weight polyethylene also has a significant abrasion-resistance factor. Polyolefin resins may also be strengthened by chemical modification, cross linking, adding filler materials, and physical reinforcement. Polyethylene resins find wide application for blow molded products such as bottles, jars, and containers generally. Polypropylene and polystyrene find application for light structural items and packaging film materials. For markedly improved strength and toughness, the components of snow blade device 10 may include a high strength, high density polycarbonate resin which is thermoplastic. Polycarbonate resins and their high strength modifications have been used advantageously for many heavy duty automotive parts including bumpers. One carbonate resin from which durable, tough, high strength, articles are prepared comprises a mixture of a carbonate resin with an acrylonitrile-butadienestyrene copolymer without copolymerization and is commercially known as Cycolac KM resin (Borg Warner-Corp.). High density polycarbonate resins have a tensile strength of 10,000 psi, however, their impact resistance when cold is less than optimal.

Snow blade 12 is preferably formed from a single sheet of one of the synthetic resin materials as described. As illustrated in FIG. 2, blade 12 is a generally narrow rectangular sheet which is curved about its longitudinal axis to provide a lower vertical section 18 and a forwardly angled upper section 19. "Forwardly" is the usual direction of motion of the transverse blade 12 moving perpendicularly against the edge of a layer of snow on a roadway over which vehicle 11 moves. Angled section 19 hinders the rapid rise of accumulated snow in front of blade 12 which may spill over blade 12 to the roadway between push bars 13 and 14. For increased lateral rigidity and to provide a convenient wear strip, section 18 of blade 12 is also formed with its lower edge turned under to define a lip 20.

As also shown in FIG. 2, blade 12 is supported by a pair of push bars 13 and 14 which are attached to automotive vehicle 11 and transmit pushing forces of vehicle 11 to snow blade 12. Push bars 13 and 14 are therefore subjected to very high stresses and are rigid structural items best described with respect to FIGS. 3 and 4.

Figure 3:
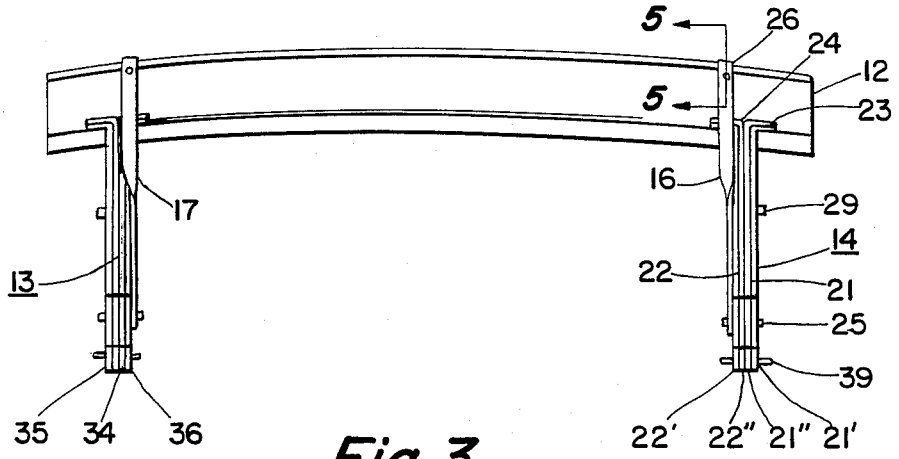
FIG. 3 is a top plan view of the snow blade device of this invention.

Referring now to FIG. 3 each push bar 13 and 14 is similar in construction to the other. Push bar 14 comprises a pair of composite synthetic resin plates 21 and 22. Each plate 21 and 22 comprises a pair of thinner synthetic resin plates 21' and 21'' and 22' and 22'' which are joined in parallel planar abutting relationships to provide high strength composite plates 21 and 22. As illustrated in FIG. 3, plates 21 and 22 are formed with flanges 23 and 24 for attachment of plates 21 and 22 to vertical section 18 of blade 12. In a preferred embodiment, flange 24 of plate 22 is extended to and joined with the flange on corresponding plate 36. Thus, one might choose to fabricate plates 22 and 36 as one U-shaped member in which the plates are joined by one continuous piece running between them behind vertical section 18 of blade 12. In any event, plates 21 and 22 are assembled in paralle relationship with each other so their flanges 23 and 24 extend laterally in opposite directions to provide a large planar surface abutting vertical section 18 of blade 12. Also, plates 21 and 22 are assembled with blade 12 so that they press against each other. Since they are somewhat flexible, however, it is possible to spread them apart at their free ends so that the tow ring of an automobile may be placed therebetween. This arrangement is an important feature of the invention because it results in an very secure attachment of the snow removal device 10 to vehicle 11 (FIG. 1) in which unwanted play is eliminated. Furthermore, the secure attachment as described results in greater conformity of the movements of the snow removal device 10 to the movements of vehicle 11.

Plate 21 can be formed using high density polyethylene in the pair of thinner plates 21' and 21'' so long as each of these inner plates is at least one-quarter of an inch in thickness. Alternatively, one may form plate 21 in a single thickness using ultrahigh molecular weight polyethylene having a thickness of at least three-eighths of an inch.

Figure 4:
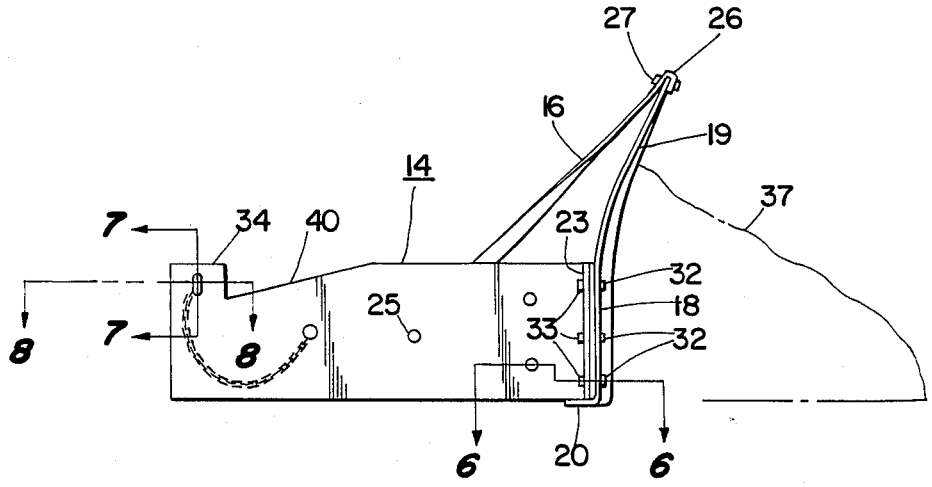
FIG. 4 is a side elevational view of the snow blade device of this invention illustrating a push bar and its means of attachment to an appropriate part of the automotive vehicle.
Figure 5:
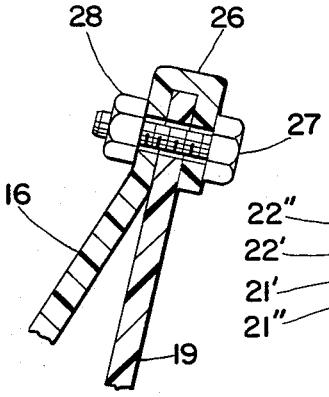
FIG. 5 is a cross-sectional view of an attachment arrangement for the braces of FIG. 3 taken along the line 5—5 thereof.

Referring now to FIG. 4, push bar 14 is shown with a vertical edge of flange 23 (opposite flange 24 not shown) in abutting relationship with vertical section 18 of blades 12 with lip 20 of blade 12 extending under push bar 14. Blade 12 is braced in its illustrated position by braces 16 and 17 which extend angularly from push bars 13 and 14 to form a truss-like rigid structure with blade 12. Each brace 16 and 17 may be a light metal bar such as aluminum or a synthetic resin laminate, with a rectangular cross-section for increased rigidity. Each brace is attached at one end to a push bar 13 or 14 by a bolt and nut assembly 25 with the bolt passing laterally through braces 16 and 17 and an adjacent push bar (FIG. 3). The other end section of brace 16 is twisted 90 degrees about its longitudinal axis so that the end of the brace may be formed with a reverse transverse bend to provide a flat U-shaped hook section 26 which, because of the 90 degree twist, is aligned with and slips over the upper edge of section 19 of blade 12. Hook section 26 is securely attached to blade 12 as shown in FIG. 5. One important function of braces 16 and 17 is to prevent the top of blade 12 from tipping forwardly during use. This is especially important when the blade 12 is used to push a large mass of heavy, wet snow.

Referring now to FIG. 5, U-shaped hook section 26 engages opposite sides of the upper edge of blade 12 in a flat surface clamping relationship. A bolt 27 passes through hook section 26 and blade 12 therein to engage a nut 28 to fixedly attach brace 16 (and similarly brace 17) to blade 12 to resist flexure thereof. The truss-like structure of braces 16 and 17 with blade 12 is fully supported by a rigid connection between push bars 13 and 14 and blade 12 as best described with respect to FIG. 6.

Figure 6:
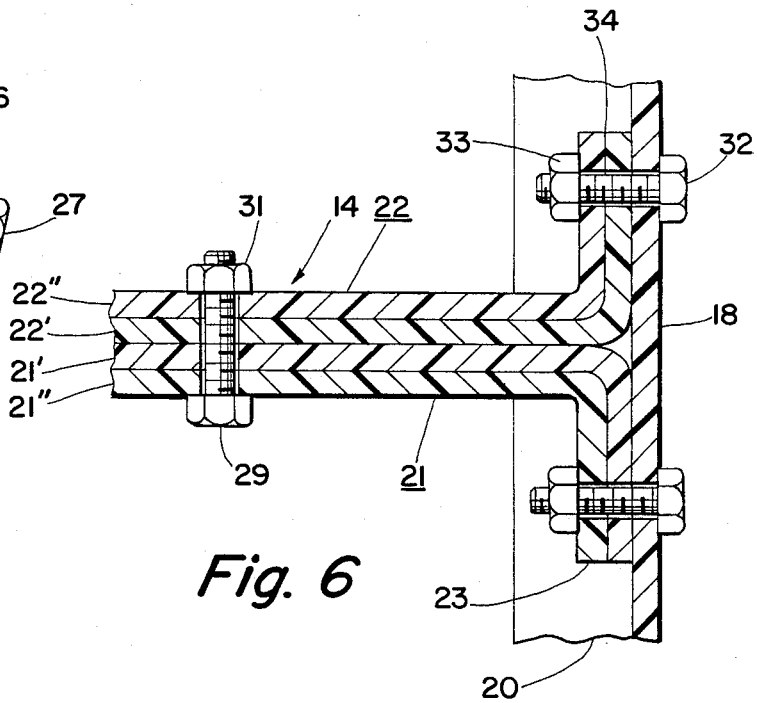
FIG. 6 is an illustration of one embodiment of a flange, bolt, and nut attachment means to attach the snow blade of this invention to the push bar of FIG. 4 taken along the line 6—6 of FIG. 4.

Referring now to FIG. 6, push bar 14 comprises a pair of composite plates 21 and 22 joined in parallel and pressing relationship with each other by means of a plurality of bolts 29 (only one shown) which passes through plates 21 and 22. This arrangement joins a pair of high strength composite plates 21 and 22 into high strength rigid push bar 14. When plates 21 and 22 are assembled as illustrated in FIG. 6, flanges 23 and 24 define a large substantially planar vertical surface which abuts vertical section 18 of blade 12. This large abutting area, in combination with flange bolts 32 which pass through blade 12 and flanges 23 and 24 to engage nuts 33 on bolts 32, provides a high strength low stress connection between push bar 14 and snow blade 12. This kind of large area connection is particularly advantageous for synthetic resin structures and bolting in this manner achieves great strength. The pushing forces exerted by the push bars 13 and 14 on blade 12 are distributed over a larger area of blade 12 minimizing high flexural stresses as well as high concentrated stresses, conditions which should be avoided when using synthetic resin structural items. For this reason the U-shaped fabrication of plates 22 and 26 mentioned above is preferred.

Snow blade 12 is conveniently formed from a single narrow rectangular sheet of a synthetic resin material, for example, a polycarbonate synthetic resin which is curved about its longitudinal axis to provide, as shown in FIGS. 2 and 4, a lower edge with a lip 20 which extends in a reverse direction under push bars 13 and 14. Lip 20 greatly increases the lateral stability of blade 12 as does the smooth concave curvature between sections 18 and 19. It is highly desirable to maintain section 19 in its forwrdly angled position to provide a shallow concave surface facing a layer of snow for more efficient snow gathering and moving purposes. Braces 16 and 17 as described also serve this purpose. Push bars 13 and 14 are also utilized to attach the snow blade device 10 to an automotive vehicle 11 as illustrated in FIG. 1.

Figure 7:
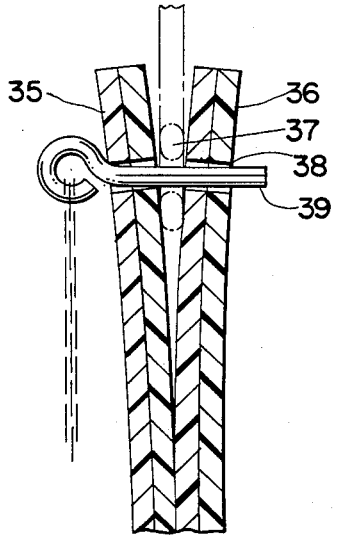
FIG. 7 is a cross-sectional view of a vertical pin lock attachment means which may be utilized to attach the snow blade device of FIG. 4 to an automotive vehicle.

As a convenience factor, the attachment arrangement utilizes an existing part of the chassis of a large number of vehicles. For example, most automotive vehicles imported into the U.S.A. from European and Asiatic countries are equipped with towing or tie down means, usually in pairs, at the front of the vehicle, one tie down at each wheel location and behind and near bumper 15 (FIG. 1). When the vehicle is loaded aboard an ocean vessel, an appropriate tensioning device is fastened to the tie down means and to an appropriate tie down means of the vessel so that the vehicle is securely attached to the vessel. Ordinarily the tie down means on the vehicle is a metal ring or apertured metal plate which also serves as towing line attachment means for the vehicle. Push bars 13 and 14 are adapted to attach to these rings. Push bars 13 and 14 are provided with upstanding extensions 34 at the free ends thereof which are utilized to attach snow blade device 10 to the tie down rings. As noted with respect to FIG. 6, push bars 13 and 14 comprise composite plates 21 and 22 in pressing engagement with each other. Snow blade device 10 is positioned at the front of vehicle 11 as illustrated in FIG. 1. In this position extensions 34 come into alignment with tie down rings 37 as illustrated in FIG. 7. As noted earlier, it is necessary to spread plates 21 and 22 so as to permit tie down ring 37 to be inserted therebetween.

Figure 8:
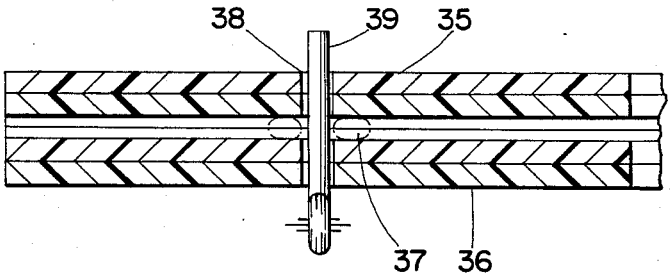
FIG. 8 is a view of a horizontal pin lock attachment means utilized to attach the snow blade device of FIG. 4 to an automotive vehicle.

Referring now to FIG. 7, tie down or towing ring 37 is shown in a vertical position and plates 35 and 36 (see FIG. 3) are on either side thereof. An aperture 38 passes transversely through plates 35 and 36 and is concentric with ring 37. A pin member 39 is inserted through the aperture 38 in plates 35 and 36 through the ring 37 therebetween to lock the sides plates 35 and 36 to ring 37 to prevent ring 37 from sliding out from between plates 35 and 36. FIG. 8 shows a similar lock arrangement for a ring 37 and extension 34 in a horizontal position. In the absence of towing or tie down rings, other exposed parts of an automotive chassis may be employed.

As illustrated in FIG. 1, the push bars 13 and 14 (not shown) are positioned in parallel spaced apart relationship perpendicular to the front of vehicle 11 and under the front bumper 15 so that extensions 34 may engage the towing or tie down rings. In order to accommodate rings 37 of different height or roadway clearance and to prevent interference with front bumper 15, push bars 13 and 14 are provided with a notch 40 (see FIG. 2) in the upper edge of their generally rectangular configuration. Notches 40 are wide angle V notches or removed sections adjacent the free end of a push bar so that one side of the V notch defines upstanding extensions 34. A notch of any other configuration, such as semi-circular, can be conveniently used to accommodate the structures encountered in various vehicles.

As illustrated in FIGS. 2 and 4, the V notches in push bars 13 and 14 are coincident and colinear with each other. When snow blade device 10 is attached to vehicle 11 as illustrated in FIG. 1, bumper 15 fits transversely in notches 40 thus permitting additional variation in the vertical dimension for extensions 34 to fit tie down rings 37 without resorting to narrower and less rigid push bars.

The pin attachment as shown in FIGS. 2, 7 and 8 in combination with notches 40 permit the snow blade device 10 to pivot about pin(s) 39 so that blade 12 may move over an irregular roadway with permitted vertical movement, i.e., without undue strain to joined parts. Ordinarily the pertinent dimensions of the snow blade device of this invention are chosen to fit a range of vehicles where chassis and other dimension are similar for different models. Accordingly, and for example, the V notches 40 in pus bars 13 and 14 may be designed to receive the bumper of a single manufacturer, although a fixed design may receive the bumper of several vehicle models of that manufacturer. A judicious selection of dimensions will provide a limited number of snow blade devices 10 which will fit a large number of vehicles 11.

In a practice of this invention, snow blade device 10 is mounted on a vehicle 11 as illustrated in FIG. 1 and the vehicle is operated in the usual manner to push snow blade device 10 through a layer or blanket of snow on the roadway. As shown in FIG. 4, snow blade 12 moves, in its transverse mounted relationship, perpendicular to the snow layer to gather up a quantity of snow in front of snow blade 12 and move the gathered snow to a desired alternate location. Thereafter, stopping and reversing the direction of vehicle 12 deposits the moved quantity of snow at the point of vehicle reverse movement. Repetitive operation as described can move a large quantity of snow from one part of a roadway to a more remote part.

Where the noted path is a large concrete roadway such as a concrete driveway leading to a residential garage, the lower edge of snow blade 12 as shown in FIG. 2 may show appreciable wear from its rubbing motion against concrete.

This invention provides a tough durable lightweight synthetic resin snow removal device which is easily attached to an automotive passenger vehicle and can efficiently remove snow, particularly from a usual path of travel of an automotive vehicle.

While this invention has been disclosed and described with respect to preferred embodiments thereof, it will be understood by those skilled in the art that various changes and modifications may be made thereto without departing from the spirit and scope of the invention as set forth in the appended claims.

What is claimed is:

1. A lightweight snow removal device particularly adapted for attachment to an automotive vehicle having tow rings depending therefrom comprising in combination:

(a) an oblong snow blade having a front and a rear and having a substantially horizontal longitudinal axis, said blade being curved along its longitudinal axis so as to have a vertical lower section and an angled upper section with the resulting concavity being on the front of the blade;

(b) a pair of planar push bars, each bar mounted on its one end to the rear of the blade so as to be in a spaced-apart parallel relationship with the other bar and each bar having a means on its other end for attachment of the bar to a tow ring; and (c) each push bar being comprised of a pair of plates in pressing engagement with each other, but separable for receiving a tow ring therebetween.

2. The invention as recited in claim 1 wherein said push bars and said snow blade comprise a synthetic resin material.

3. The invention as recited in claim 1 wherein said push bars and said snow blade comprise a high density polycarbonate resin.

4. The invention as recited in claim 1 wherein said push bars and snow blade comprise a polyolefin material.

5. The invention as recited in claim 1 wherein each plate in a pair is provided with an aperture, the apertures of the pair being aligned with each other, and wherein the invention further comprises a pin associated with each push bar for insertion through the apertures of its plates in order to lock a tow ring therebetween.

6. The invention as recited in claim 1 wherein the automotive vehicle has a bumper and wherein each push bar is provided with a notch so that the bumper can pass therethrough when the push bars are attached to the tow rings.

7. The invention as recited in claim 1 wherein said snow blade includes a lip section formed along one edge thereof with the lip underlying said push bars.

* * * * *